United States Patent [19]

Crawford

[11] Patent Number: 4,576,015

[45] Date of Patent: Mar. 18, 1986

[54] LIGHTWEIGHT HIGH PRESSURE TUBULAR STORAGE SYSTEM FOR COMPRESSED GAS AND METHOD FOR CRYOGENIC PRESSURIZATION

[76] Inventor: A. Gerrit Crawford, 6223 Bakman St., North Hollywood, Calif. 91606

[21] Appl. No.: 484,878

[22] Filed: Apr. 14, 1983

[51] Int. Cl.[4] ..... F25B 45/00

[52] U.S. Cl. ..... 62/292; 62/45; 137/587; 220/3

[58] Field of Search ..... 62/292, 45; 220/3; 137/587

[56] References Cited

U.S. PATENT DOCUMENTS

| | | | |
|---|---|---|---|
| 2,326,130 | 8/1943 | Kleen | 62/292 |
| 2,684,180 | 7/1954 | Allen | 220/3 |
| 3,044,654 | 7/1962 | Creighton | 220/3 |
| 3,125,135 | 3/1964 | Boyer et al. | 137/587 |
| 3,252,610 | 5/1966 | Greenlee | 220/3 |
| 3,432,060 | 3/1969 | Cowley | 220/3 |

*Primary Examiner*—Ronald C. Capossela
*Attorney, Agent, or Firm*—W. Edward Johansen

[57] ABSTRACT

The present invention is a lightweight high pressure tubular storage system for storing and transporting a gas which includes a tubular member being formed from a metallic or composite material and having an opening in the first end and preferably an opening in the second end. The storage system also includes an inlet valve for bringing a cryogenic fluid into the tubular member wherein the preferred inlet valve is a high pressure ball valve which is fluidly coupled to the first end and an outlet valve for regulating the flow of a compressed gas from the tubular member. The outlet valve is an ambient pressure balanced piston-type valve which has a needle valve shut-off mechanism for positively shutting off the flow of the compressed gas and which is preferably fluidly coupled to the second end whereby the cryogenic fluid which is introduced through the inlet valve is contained and allowed to warm up within the tubular member and change into the compressed gas. The outlet valve also has a flow limiting inlet orifice which is fluidly coupled to the second end of the tubular member. The ambient pressure is sensed by means of a fluid filled passage in which the fluid is retained by an elastomeric diaphragm. The present invention is also a method of filling a storage system with a cryogenic liquid at a temperature below the boiling point of the cryogenic fluid and enclosing the cryogenic liquid so that it can warm up to a temperature above its critical temperature in order to change into a compressed gas.

4 Claims, 6 Drawing Figures

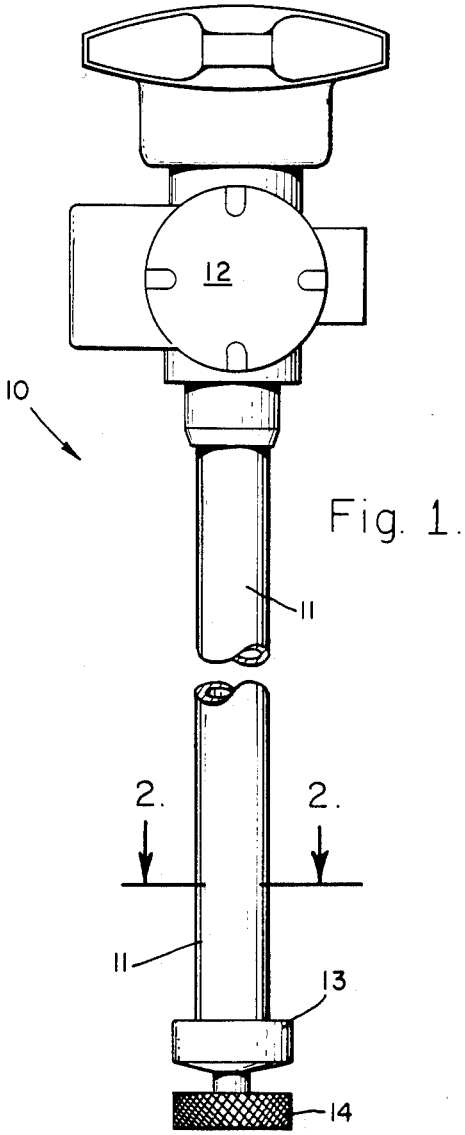
Fig. 1.
Fig. 2.
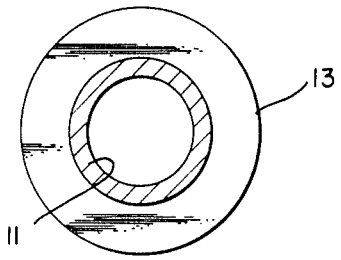
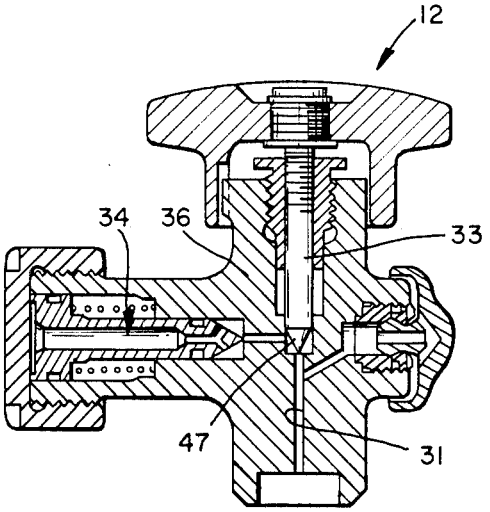
Fig. 3.
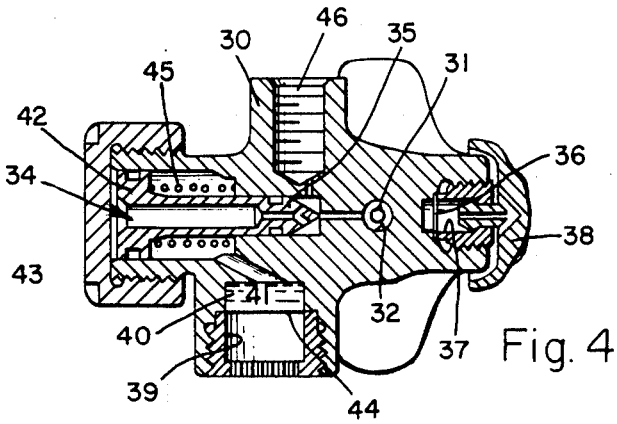
Fig. 4.

LIGHTWEIGHT HIGH PRESSURE TUBULAR STORAGE SYSTEM FOR COMPRESSED GAS AND METHOD FOR CRYOGENIC PRESSURIZATION

BACKGROUND OF THE INVENTION

1. Field of the Invention

The present invention relates to a high pressure tubular storage system for for storing gases and more particulaly a high pressure storage system in which tubular tankage is filled with cryogenic liquid at a temperature of below its boiling point so that it warms up to a temperature above its critical temperature in order change into a compressed gas.

2. Description of the Prior Art

U.S. Pat. No. 4,023,696, entitled Bottles for Compressed Gases of AU6MGT, issued to Marc Anagnostidis on May 17, 1977, teaches bottles for compressed gases which are formed from AU6MGT and which have good mechanical properties and resilience in addition to resistance to intercrystalline corrosion and to cororosion under tension. The bottles are formed by drawing a cylindrical part and a base on a mandrel, in the absence of supports or, better still, by the combined drawing of an extruded blank, quenched and aged. The end of the cylindrical part is tapered at a temperature of from 350° C. to 400° C. The propagation of heat towards the cylindrical part is prevented by means of cooling ring, and finally by quenching in cold water until the cooling is complete. The bottles obtained by this method are extremely safe to use and satisfy the most stringent requirements, in particular in the field of aviation, space vehicles and in every case where it is desired to combine minimum weight with good resilience and high resistance to corrosion.

U.S. Pat. No. 2,541,065, entitled High-Pressure Container, issued to Sam Jabour on Feb. 13, 1951, teaches a container which is constructed for confining a high pressure fluid medium and which is a one-piece substantially, rigid, seamlessly formed metallic cylinder which has a cylindrical wall of substantially uniform thickness throughtout. The high-pressure container confines the high-pressure fluid medium at high pressures and has a generally ellipsoidal outwardly formed closed end wall provided with radial formations extending axially outwardly out of the end wall a relatively short distance beyond the center point portion of the end wall. The end wall has a thickness at least equal to the thickness of the cylindrical wall whereby the strength thereof due to its shape and thickness is at least equal to the the cylindrical wall in resisting the internal pressure and whereby the container of maximum strenghth is provided having the lightest possible weight for a given diameter and volume and material and having minimunm overall length for a given volume and diameter. The radial formations serve as base portions for standing the container in an unwright position.

U.S. Pat. No. 3,024,936, entitled Pressure Vessels and Method of Making Same, issued to Clyde C. Lodue, Jr. on Mar. 13, 1963, teaches a which includes a first metal cylinder having an open end and a closed end and a second metal cylinder having an open end and a closed end. The first and second metal cylinders have cylindrical side walls of substantially equal length. The open end of the metal second metal cylinder engages the closed end of the first metal cylinder in snugly abutting, sealing relationship therewith. The cylindrical side walls are telescoped in interfitting relationship and a mastic seal is disposed continuously and uninterruptedly between the cylindrical walls of the first and second cylinder to provide a laminated cylindrical wall consruction of the container.

U.S. Pat. No. 3,843,010, entitled Metal Lined Pressure Vessel, issued to William George Morse and Thomas Edward Timberlake on Oct. 22, 1974, teaches a lightweight, high strength-composite substantially all metal lined pressure vessel which is made by reinforcing the liner with an overwrap of resin impregnated filamentary material. End caps or polar boss fittings are attached by a biasable seal. The pressure vesslel is substantially free of failure forming stress concentration and is substantially impermeable to the fluids stored therein. The vessel is capable of withstanding repeated pressurization-depressurizaiton.

U.S. Pat. No. 4,000,826, entitled Cryogenic Transport, issued to Thelmer A. Rogers on Jan. 4, 1977, teaches a structural tank for carrying cold fluids which includes a cylindrically portion and hemispherical heads. The tank is horizontally structurally supported by the heads. The cylindrical portion carries an outside vacuum insulation shell and a vacuum shell is placed in side of each the structural heads.

U.S. Pat. No. 4,183,221, entitled Cryogenic Liquified Gas Tank, issued to Katsuro Yamamoto on Jan. 15, 1980, teaches a cryogenic liquified gas tank which is composed of a gas-tight outer vessel, a heat insulating layer provided at the inside of the outer vessel and a liquid-tight inner vessel made of concrete and provided at the inside of the heat insulating layer, wherein the hydraulic pressure of the cryogenic liquified gases loaded in the inner pressure vessel is supported by the concrete inner vessel while the gas pressure of the liquified cryogenic gases is supported by the gas-tight outer vessel.

U.S. Pat. No. 3,250,286, entitled Gas Pressure Regulator, issued to George L. Hammon on May 10, 1966, teaches a gas pressure regulator which includes a main body having a cavity therein and a diaphragm dividing the cavity into a first chamber and a second chamber. The gas pressure regulator also includes a high pressure gas inlet passageway into the second chamber leading from the extension of the body, a low pressure gas outlet from the first chamber to the exterior of the body and a gas valve in the high pressure gas inlet passageway. The diaphragm has a continuous outer edge the entire portion of which is in contact with the an interior shoulder of the body and a compressible spring is located within the second chamber for yieldably holding the outer edge of the diaphragm in gas-tight relationship with the shoulder and a mechanism for adjusting the compression of the spring.

U.S. Pat. No. 3,329,158, entitled Balanced, Single Stage-Single Hose Regulator, issued to John J. Gelszer on July 4, 1967, teaches a valve for regulating a flow of fluid at pressures well above 150 pounds per square inch.

U.S. Pat. No. 2,951,676, entitled Balanced Valve, issued to Andre Gruget on Sept. 6, 1960, teaches a fluid handling system including a casing having a high pressure side and low pressure side and a valve in the casing for controlling the flow of gas from the high pressure side to the low pressure side.

SUMMARY OF THE INVENTION

In view of the foregoing factors and conditions which are characteristic of the prior art it is the primary object of the present invention to provide a high pressure tubular storage system for for storing and transporting a gas in which tubular tankage is filled with cryogenic liquid at a temperature below its boiling point and allowed to warm up to its critical temperature and change into a compressed gas.

It is another object of the present invention to provide a high pressure tubular storage system for storing and transporting a gas which has a balanced regulator which controls the volume and the pressure of the flow outlet of the tubular tankage of the high pressure tubular storage system.

It is still another object of the present invention to provide a high pressure tubular storage system for storing and transporting a gas which has a flow limiter on its outlet.

It is yet another object of the present invention to provide an improved process for filling a high pressure tubular storage system for storing and transporting a gas with a cryogenic liquid which is allowed to warm up and change into a compressed gas which has a gaseous volume many times its liquid volume, but which remains compressed within the tubular tankage at a very high pressure.

In accordance with the present invention an embodiment of a lightweight high pressure tubular storage system for storing gas which includes a tubular member being formed from a metallic or composite material and having an opening in the first end and preferrably an opening in the second end is described. The high pressure tubular storage system also includes an inlet valve for bringing a cryogenic fluid into the tubular member wherein the preferred inlet valve is a high pressure ball valve which is fluidly coupled to the first end and an outlet valve for regulating the flow of a compressed gas from the tubular member. The outlet valve is an ambient pressure balanced piston-type valve which has a needle valve shut-off mechanism for positively shutting off the flow of the compressed gas and which is preferrably fluidly coupled to the second end whereby the cryogenic fluid which is introduced through the inlet valve is contained and allowed to warm up within the tubular member and change into the compressed gas. The outlet valve also has a flow limiting inlet orifice which is fluidly coupled to the second end of the tubular member. The ambient pressure is sensed by means of a fluid filled passage in which the fluid is retained by an elastomeric diaphragm. The present invention is also a method of filling a storage system with a cryogenic liquid at a temperature below the boiling point of the cryogenic fluid and enclosing the cryogenic liquid so that it can warm up to a temperature above its critical temperature in order to change into a compressed gas.

The features of the present invention which are believed to be novel are set forth with particularity in the appended claims.

Other claims and many of the attendant advantages will be more readily appreciated as the same becomes better understood by reterence to the following detailed description and considered in connection with the accompanying drawing in which like reference symbols designate like parts throughout the figures.

DESCRIPTION OF THE DRAWING

FIG. 1 is an elevational view of perspective drawing of a lightweight high pressure tubular storage system for storing and transporting a gas which includes an outlet valve, an inlet valve and tubular member and which has been constructed in accordance with the principles of the present invention.

FIG. 2 is a transverse view in cross-section view of the lightweight high pressure tubular storage system for storing and transporting a gas of FIG. 1 along the line 2—2.

FIG. 3 is an elevational view in cross-section of the outlet valve of FIG. 1.

FIG. 4 is a transverse view in cross-section of the outlet valve of FIG. 1.

DESCRIPTION OF THE PREFERRED EMBODIMENT

Figure 5:
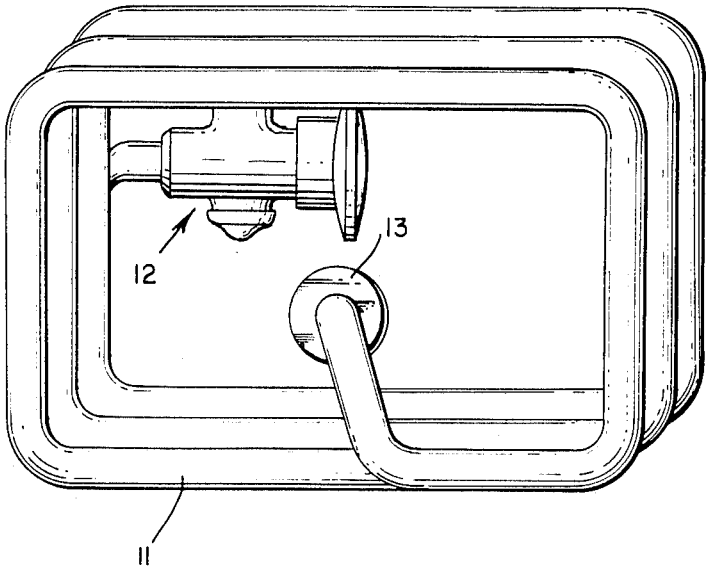
FIG. 5 is a perspective drawing of a first embodiment of the lightweight high pressure tubular storage system for storing and transporting a gas of FIG. 1.
Figure 6:
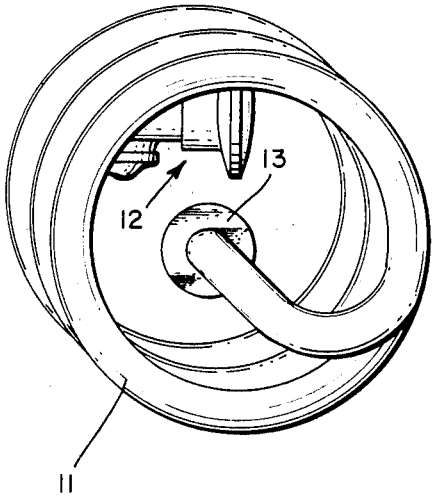
FIG. 6 is a perspective drawing of a second embodiment of the lightweight high pressure tubular storage system for storing and transporting a gas of FIG. 1.

In order to best understand the present invention it is necessary to refer to the following description of its preferred embodiment in conjunction with the accompanying drawing. Referring to FIG. 1 in conjunction with FIG. 2 a high pressure storage system 10 for storing gas which includes a tubular member 11 being formed from a metallic material and having a first end and a second end. The high pressure storage system 10 also includes an outlet valve 12 for regulating the flow of a compressed gas from the tubular member 11 and an inlet valve 13 with a shut-off handle 14 for bringing a cryogenic fluid into the tubular member 11. The inlet valve 13 is a high pressure ball valve which is fluidly coupled to the first end of tubular member 11 which is thin-walled and of uniform diameter throughout being formed from a metallic or composite material and has an open first end and an open second end to which fittings, valves, coupling and/or closure can be affixed. The outlet valve 12 and the inlet valve 13 are fixedly coupled to the tubular member 11 by being welded together.

Referring to FIG. 3 in conjunction with FIG. 1 and FIG. 4 the outlet valve 12 has a valve body 30 with an inlet 31 which has a flow limiting orifice 32 and a needle valve shut-off mechanism 33 for positively shutting off the flow of the compressed gas and which is fluidly coupled to the second end of the tubular member 11 whereby the cyrogenic fluid is allowed to warm up within the tubular member 11 and change into the compressed gas. The outlet valve 12 also includes an ambient pressure referenced balanced piston-type valve mechanism 34 which is fluidly coupled to the needle valve shut-off mechanism 33. The outlet valve 12 further includes a safety mechanism 35 which has a burst disc 36 disposed in a safety outlet bore 37 in the valve body 30, which is fluidly coupled to the inlet 31 of the valve body 30, and a high pressure gas deflector 38 axially aligned with the safety outlet bore 37. The ambient pressure referenced balanced piston-type valve mechanism 34 includes a first chamber 39 which is open to the atmosphere and which is therefore at atmospheric pressure and a second chamber 40 which is filled with liquid silicone 41 and which is coupled to a piston 42 in which is slidably disposed within a piston chamber 43. An ambient sensing diaphragm 44 is dispo a piston 42 in which is slidably disposed within a piston chamber 43. An ambient sensing diaphragm 44 is disposed between the first and second chambers 39 and 40. A spring 45 resiliently biases the piston 42 so that the piston is set at 150 pounds per square inch. The valve body 30 has an outlet 46 which is fluidly coupled to the piston chamber 43 on one side thereof. The piston chamber 43 is fluidly coupled to the inlet 31 adjacent to a first needle member 47 of the needle valve shut-off mechanism 33. The piston 42 has a second needle member 48 which the spring 45 normally, resiliently biases in the closed position, but which moves when a device which is fluidly coupled to the outlet 47 "demands" that a volume for compressed gas be delivered through the outlet at the rate of 150 pounds per square inch.

The present invention is also a method of filling a high pressure storage system for storing a gas consisting of the steps of filling a tubular member which has a first end which has an open ball valve and a second end which is closed by a balanced valve, through the open ball valve with a cryogenic liquid at a temperature below −225° F. and closing the ball valve and allowing the cryogenic liquid to warm to a temperature above −150° F. and change into a compressed gas.

From the foregoing it can be seen that a lightweight high pressure tubular storage system for storing and transporting a gas has been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. A lightweight high pressure tubular storage system for storing and transporting a gas comprising:

a. a thin-walled tubular member of uniform diameter throughout being formed from a metallic or composite material and having an open first end and an open second end to which fittings, valves, coupling and/or closure can be affixed;

b. inletting means for bringing a cryogenic fluid into said tubular member wherein said inletting means is fluidly coupled to said first end; and c. outletting means for regulating the flow of a compressed gas from said tubular member wherein said outletting means is fluidly coupled to said second end whereby the cyrogenic fluid is allowed to warm up within said tubular member and change into the compressed gas.

2. A lightweight high pressure tubular storage system for storing and transporting a gas according to claim 1 wherein said inletting means for bringing a cryogenic fluid into said tubular member comprises a high pressure inlet shut-off valve.

3. A lightweight high pressure tubular storage system for storing and transporting a gas according to claim 2 wherein said outletting means for regulating the flow of the compressed gas from said tubular member comprises:

a. an ambient pressure referenced balanced piston-type valve which has a needle valve shut-off mechanism for positively shutting off the flow of the compressed gas; and b. a flow limiting orifice fluidly coupled to said second end of said tubular member.

4. A lightweight high pressure tubular storage system for storing and transporting a gas according to claim 3 wherein said tubular member is cut, coiled, shaped, encapsulated and bent in order to accommodate a specific packaging requirement.

* * * * *